United States Patent [19]

Goodwin

[11] Patent Number: 4,724,644

[45] Date of Patent: Feb. 16, 1988

[54] WALL PANELLING SYSTEM

[75] Inventor: David Goodwin, Pyrford, United Kingdom

[73] Assignee: Thrislington Sales Limited, Clwyd, United Kingdom

[21] Appl. No.: 913,779

[22] Filed: Sep. 30, 1986

[30] Foreign Application Priority Data

Sep. 30, 1985 [GB] United Kingdom ..... 8524067

[51] Int. Cl.[4] ..... A47K 3/16

[52] U.S. Cl. ..... 52/34; 52/239; 52/243.1

[58] Field of Search ..... 52/243.1, 34, 239, 213, 52/217; 206/325; 49/380, 505

[56] References Cited

U.S. PATENT DOCUMENTS 2,316,425 4/1943 Hasenburger et al. ..... 52/210
2,930,480 3/1960 Brown ..... 49/380
3,194,362 7/1965 Wargo ..... 52/239
3,216,066 11/1965 Hadachek ..... 206/325

FOREIGN PATENT DOCUMENTS 1254355 1/1961 France ..... 52/243.1

*Primary Examiner*—James L. Ridgill, Jr.
*Attorney, Agent, or Firm*—Edwin D. Schindler

[57] ABSTRACT

A panelling system for the construction of cubicles having two upright posts, a panel connected to one of the posts by a hinge and two cross rails running between the posts. Each of the upright posts has a similar, but laterally inverted, cross-sectional shape. The posts are attached to the floor and ceiling by means of channel members and to a rear wall by means of wall brackets which also serve to support service supplies. The panels may support various items, such as W.C.'s, washbasins, etc.

9 Claims, 5 Drawing Figures

WALL PANELLING SYSTEM

A panelling system for the construction of cubicles comprising two upright posts, a panel connected to one of the posts by a hinge and two cross rails running between the posts. The posts are attached to the floor and ceiling by means of channel members and to a rear wall by means of wall brackets which also serve to support service supplies. The panels may support various items such as W.C.'s, washbasins, etc.

BACKGROUND OF THE INVENTION

1. Field of the Invention

The present invention relates to a wall panelling system for example for use in the construction of public sanitary areas.

2. Description of Related Art

In known methods of erecting panelling for public sanitary areas, such as lavatories and washrooms the greater part of the construction work is carried out on-site. Thus, timber members are cut to size and fitted together to form a framework, and panels are cut to size and attached to the framework. The framework must also support any sanitary units, pipework etc. Clearly, this method requires a great deal of on-site expertise and calls for accurate work under inconvenient conditions, and is particularly difficult when accurate location of large components is required.

SUMMARY OF THE INVENTION

It is an object of the present invention to provide a panelling system which can be constructed with a minimum of on-site work.

It is a further object to provide such a system with sufficient tolerance to allow for on-site adjustability.

It is a further object to provide such a system which allows easy access to the region behind the pannelling.

According to the invention, there is provided a panelling system comprising two upright posts, a panel, a hinge connecting the panel to one of the posts, a top cross rail running between the two posts, a bottom cross rail running between the two posts, an intermediate cross member running between the two posts arranged to support fittings associated with the panel, and means for locking the panel to the other post, the posts each having a cross-sectional shape providing features for the attachment of the hinge, the cross rails, the cross member and the panel locking means.

Thus, the majority of the accurate sizing and preparation of the components may be carried out prior to their delivery to the site, e.g. in a factory. Preferably, the posts are metal extrusions and so, effectively, the accuracy of the final structure is attained through the accuracy of the extrusion and the preparatory work in the factory, rather than on-site expertise in preparing the basic components.

One particularly difficult on-site operation which can be avoided is hanging the panel on a hinge, since the hinge can be attached to the panel in the factory while the necessary means for attachment are present in the form of the post. This is a great advantage when the relevant panel is large and therefore heavy. Similarly, all the panel locking components can be pre-positioned in the factory.

The hinged connection of the panel allows for easy access to any components created behind the panel. In the case of the panels associated with water closets, washbasins etc., such components may include water supply, drains and possibly a power supply.

Preferably, the system includes a foot member for each post, the cross-sectional shape of each post providing a feature for engagement with the respective foot member.

Preferably, the system further includes brackets for attaching the posts to a wall, the cross-sectional shape of the posts providing features for the attachment of the brackets.

The system may also include an infil panel to fill the space between one of the two posts and another adjacent post, the cross-sectional shape of each post providing a feature for the attachment of the infil panel. Each foot member may comprise a foot with an upright threaded member and an adjustable nut on the threaded member, the upright being received by a cross-sectional feature of the post and the post being adjustably supported by means of the nut. These features may provide a degree of on-site adjustability, both horizontally and vertically.

Preferably, the cross-sectional shape of each post provides a feature arranged to engage another adjacent post thereby defining a minimum spacing between the adjacent posts. Preferably, the panel locking means comprises a plate fixed to the panel, a bracket fixed to the post, and means fixing the plate to the brackets. By adopting this arrangement, it is possible to eliminate surface fixings on the panel.

The hinge may be a piano-type hinge fixed to the panel and the post. Alternatively, the hinge may comprise an element having an elongate circular-sectioned bead attached to the panel, and a corresponding elongate channel formed as part of the post arranged to receive the bead and to allow limited rotation.

The system preferably further includes a horizontal channel for attachment to the floor, in which channel the feet are received. It may also include a pair of inverted post members, one at the top of each post and a horizontal channel for attachment to a ceiling, in which channel the inverted post members are received. A skirt may be attached to each horizontal channel.

Naturally, a series of panels may be located side-by-side, all using common horizontal channels for the feet. They may be separated by various infil panels which may be right-angled, internally or externally or which may include partitions, for example, to define cubicles.

The intermediate cross member may be a sturdy timber element which may be used to support the components in front of the panels, such as wash basins etc.

BRIEF DESCRIPTION OF THE DRAWINGS

The invention may be carried into practice in various ways and some embodiments will now be described by way of example with reference to the accompanying drawings, in which.

Figure 1:
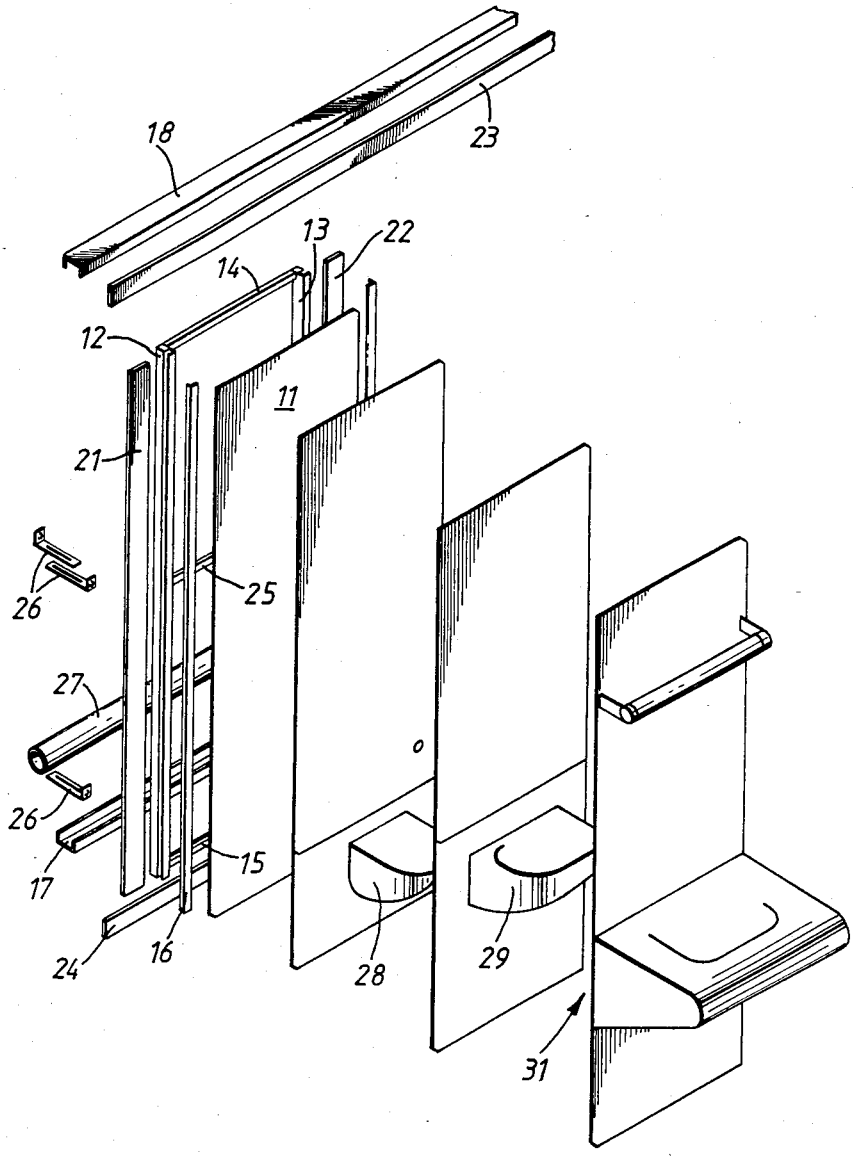
FIG. 1 is an exploded diagrammatic representation of a system in accordance with the invention, showing alternative forms of panels.

Referring firstly to FIG. 1, the panelling system basically comprises a panel 11, a pair of upright posts 12, 13 connected by a top rail 14 and a bottom rail 15, a hinge 16 connecting the panel 11 to the post 12, a bottom channel member 17 and a top channel member 18 respectively fixed to the floor and a ceiling. The posts 12, 13 are received within the channels 17, 18 by means of foot members 19 which are shown in more detail in FIGS. 3 and 5. The panel 11 is fixed to the other post 13 by a locking arrangement which is shown in more detail in FIGS. 2 and 4.

The system also comprises infil panels 21, 22 to either side of the posts 12, 13 which fill the space between these posts and adjacent posts, upper and lower skirts 23, 24 which are located in front of the two channels 17, 18, and an intermediate cross member 25. The entire system is fixed to a rear wall by means of brackets 26 which are bolted to the posts 12, 13. These also serve to support services 27.

FIG. 1 also shows some alternative forms of panel 11. Thus, the panels may have a w.c. 28 or a wash basin 29 or may comprise a vanity unit 31.

Figure 2:
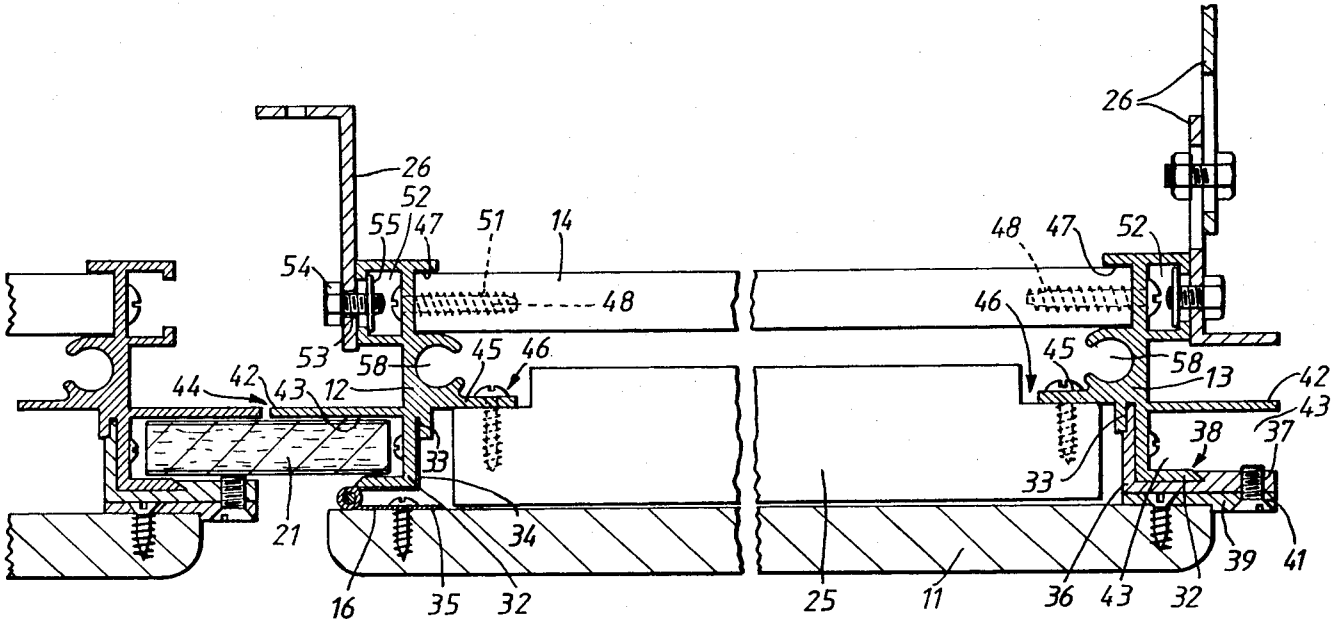
FIG. 2 is a horizontal section through a system in accordance with the invention.
Figure 3:
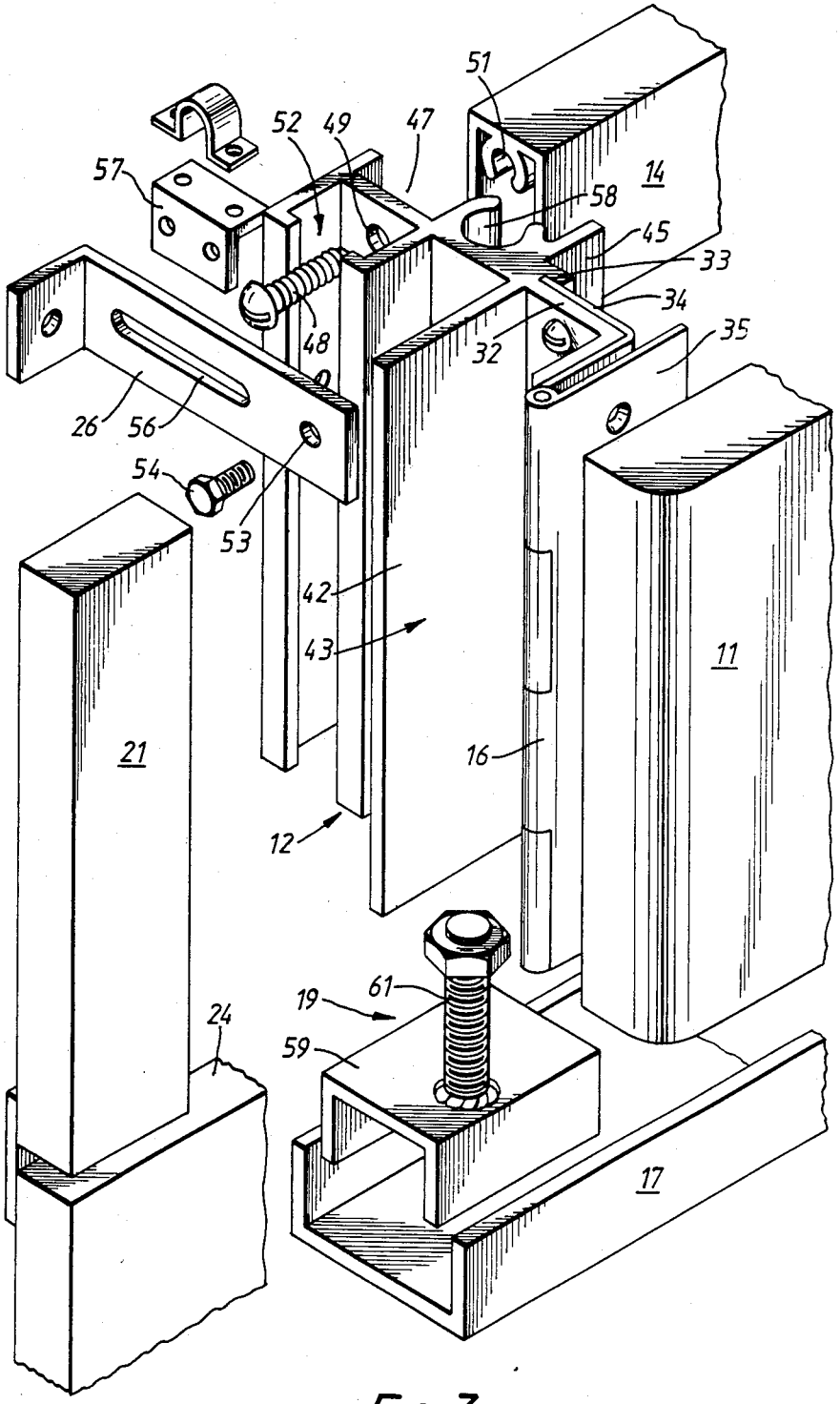
FIG. 3 is an isometric sketch of a post from one side.
Figure 4:
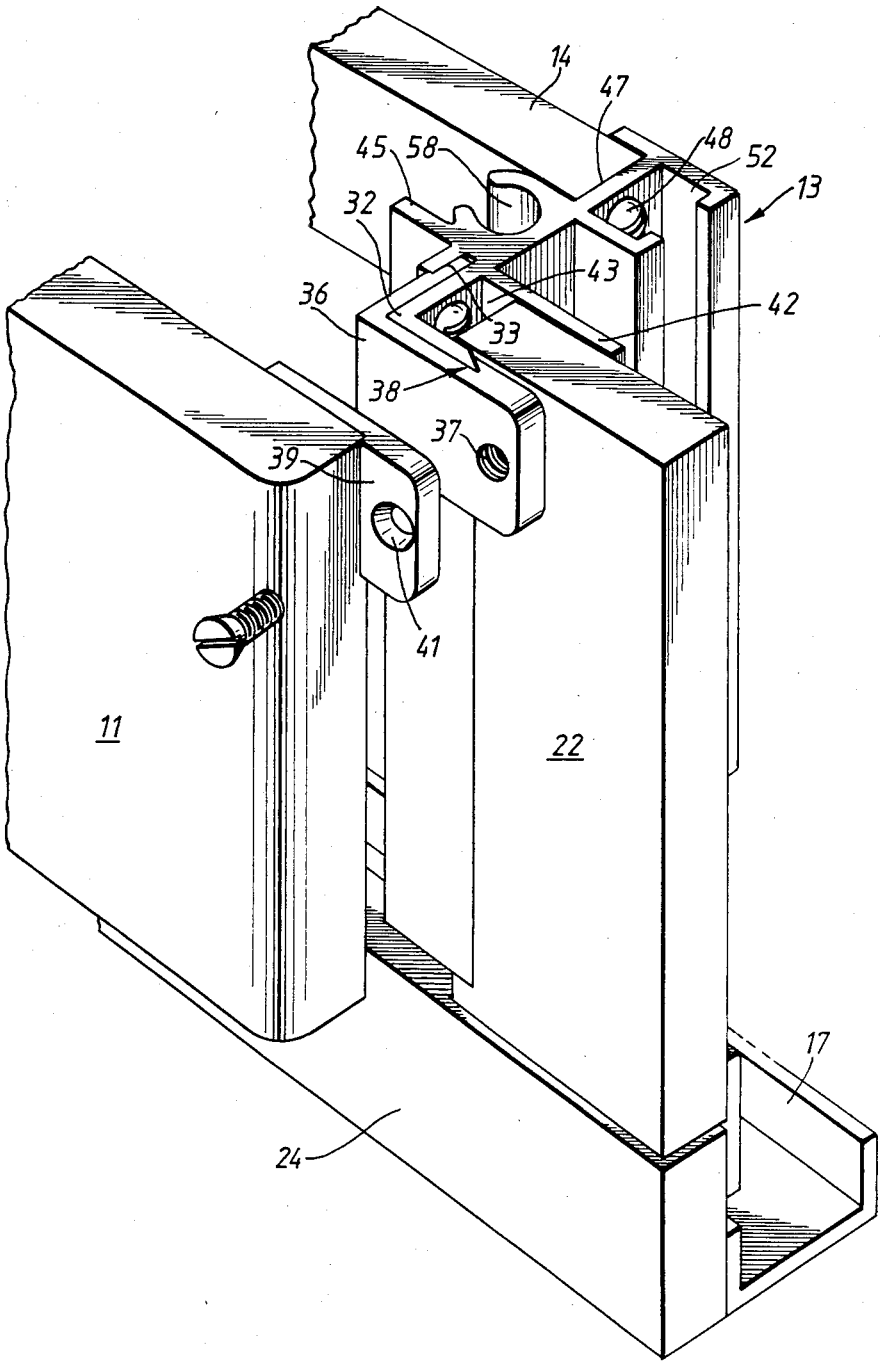
FIG. 4 is a view similar to FIG. 3 but from the other side.

As can be seen from FIGS. 2, 3 and 4, the posts 12, 13 are each in the form of a metal extrusion having a relatively complicated cross-section. This cross-section includes all the features necessary for connecting the post 11, 12 to the various other components.

At the front of a post, e.g. 12, there is a right-angled flange 32 and rearwards from this, a rebate 33 facing fowards. The hinge 16 has a right-angled flap 34 which fits in the rebate 33 and extends around the right-angled flange 32 where it is screwed in position. The other flap 35 of the hinge 16 is screwed to the rear of the panel 11. The other post 13 is a mirror image of the first post 12 and its right-angled flange 32 and rebate 33 serve to locate right-angled brackets 36 (of which one is shown), each having a tapped hole 37. The precise location of each bracket 36 is helped by the end of the right-angled flange being chamfered and the bracket 36 being correspondingly profiled as shown at 38. In order to fix the panel 11 to the post 13, a plate 39 is screwed to the panel 11 which has a hole 41 which registers with the tapped hole 37, thus enabling the plate 39 and the bracket 36 to be bolted together.

Rearwards from the right-angled flange 36 there is a wide flange 42 extending parallel, thereby defining a recess 43 for the infil panel 21 or 22. The extent to which the infil panel 21, 22 extends into the recesses 43 on two adjacent posts can be varied, thereby providing a degree of on-site adjustability. As shown in FIG. 2, the wide flange 42 is so dimensioned that even when two such flanges 42 on adjacent posts abut as shown at 44, the posts are sufficiently spaced apart to allow the panel 11 to be opened on its hinge 16 without fouling on an adjacent panel.

Extending in the opposite direction to the wide flange 42 there is a narrower flange 45. This has holes provided at the appropriate positions to enable the intermediate cross member to be screwed to the posts 12, 13 as shown at 46 in FIG. 2. At the rear of each post 12, 13 on the same side as the narrower flange 45, there is a recess 47 for the rails 14, 15. The rails 14, 15 are fixed in position by means of bolts 48 passing through holes 49 in the base of the recess 47 and into a corresponding opening 51 in the channels 14, 15.

At the rear of each post 12, 13 on the same side as the wide flange 42 there is a narrow-necked channel 52 by means of which the wall brackets 26 are fixed to the post e.g. 12. The wall brackets 26 have a hole 53 through which a bolt 54 passes into the channel 52 where it is locked by means of a generally rectangular nut 55 having two rounded corners. This enables the nut 55 to pass into the channel in one orientation but prevents it from rotating within the channel 52. The wall brackets 26 also have an elongate slot 56 for the attachment of angle brackets etc 57. This enables the wall brackets 26 to support service supplies.

Figure 5:
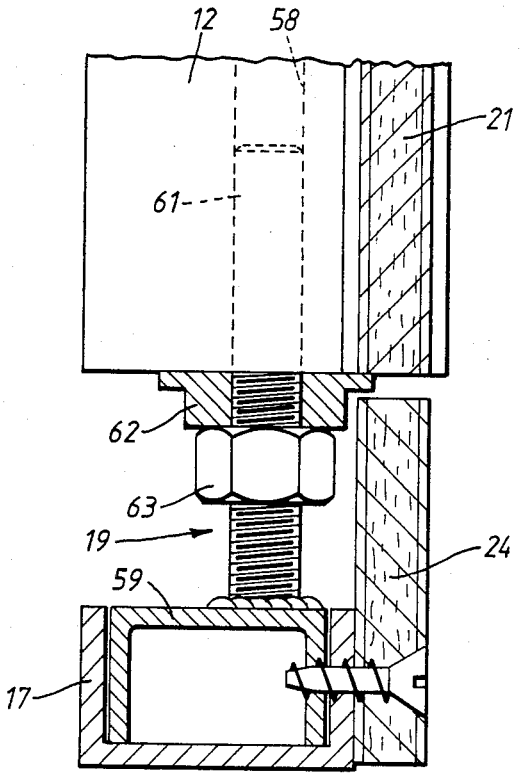
FIG. 5 is a vertical section through a foot member.

Finally, the posts 12, 13 each have a generally cylindrical base 58 located between narrower flange 45 and the rail recess 47. This serves to connect a post e.g. 12 with a post member 19, as shown in FIGS. 3 and 5. Each post member 19 comprises a post 59 of inverted U-shape and a threaded shaft 61 welded to the foot 59. The foot 56 is located in the bottom channel member 17 and the shaft 61 is located in the bore 58. A flanged washer 62 supports the post 12 and this is in turn supported by a nut 63 on the shaft 61. This enables a certain amount of on-site height adjustment to be carried out.

A similar (but inverted arrangement) is used to connect the posts 12, 13 to the top channel member 18. In both cases, the skirts 23, 24 are bolted or screwed to their respective channel members 18, 17.

Thus, when such a system is to be installed, the location is measured and using these measurements the desired sizes of the components are calculated. These are then cut or manufactured to size in the factory and the required fittings are accurately fixed to the components. When these are taken to the site, it is simply necessary to fix the top and bottom channel members to the floor and ceiling, and then connect the components together with their predetermined relationships.

Obviously, numerous modifications and variations of the present invention are possible in the light of the above teachings. It is therefore to be understood that within the scope of the appended claims, the invention may be practised otherwise than as specifically described herein.

I claim:

1. A panelling system, comprising:

a panel;

two upright posts attached to said panel, each of said posts having a front and a rear, said two posts each having a similar, but laterally inverted cross-sectional shape;

a hinge connecting said panel to the front of one of said posts;

a foot member for each of said posts, each of said foot members including an upwardly extending pin;

a top cross rail connecting said two posts;

a bottom cross rail connecting said two posts;

an intermediate cross member being arranged to support fitting associated with said panel; and means for locking said panels of each of said posts to said post which said panel is not connected to, so that said laterally inverted cross-sectional shape of said two posts provide a surface at the front to which said hinge is attached in the case of one of said posts and to which said panel locking means is attached in the case of said other post, a longitudinally extending opening being located rearwardly of said surface, said opening receiving said pin of one of said foot members, and a first longitudinal channel being located rearwardly of said opening, said channel receiving said top cross rail, said bottom cross rail and said intermediate cross member.

2. The panelling system according to claim 1, further comprising brackets for attaching said two posts to a wall, said cross-sectional shape of each of said posts providing a second longitudinal channel being located rearwardly of said surface for the attachment of said brackets.

3. The panelling system according to claim 1, further comprising an infil panel to fill a space between one of said two posts and a third, adjacent post, said cross-sectional shape of each post providing an additional longitudinal channel located immediately rearwardly of said surface, said additional channel receiving said infil panel.

4. The panelling system according to claim 1, wherein said cross-sectional shape of each of said posts provides a laterally extending flange arranged to engage the corresponding flange on another adjacent post thereby defining a minimum spacing between adjacent posts.

5. The panelling system according to claim 1, wherein said panel locking means further includes a plate fixed to said panel, a bracket fixed to said surface at the front of said other posts, and means for fixing said plate to said bracket.

6. The panelling system according to claim 1, wherein each of said foot members includes a threaded member which constitutes said pin and an adjustable nut on said threaded member, said posts thereby being adjustably supportable by means of said nut.

7. The panelling system according to claim 6, further comprising a horizontal channel for attachment to a floor, said horizontal channel being capable of receiving said foot members.

8. The panelling system according to claim 7, further comprising a pair of inverted foot members, with one of said inverted foot members at the top of each of said posts, and a second horizontal channel for attachment to a ceiling, said second horizontal channel being capable of receiving said inverted foot members.

9. The panelling system according to claim 8, further comprising a skirt attached to each of said horizontal channels.

* * * * *